US009383683B2

(12) United States Patent
Honda et al.

(10) Patent No.: US 9,383,683 B2
(45) Date of Patent: Jul. 5, 2016

(54) TRANSPORT MECHANISM, DEVELOPING DEVICE, AND IMAGE FORMING APPARATUS

(71) Applicant: FUJI XEROX CO., LTD., Minato-ku (JP)

(72) Inventors: Fumiyuki Honda, Kanagawa (JP); Takashi Ochi, Kanagawa (JP); Yasuaki Watanabe, Kanagawa (JP); Tomoyuki Yoshii, Kanagawa (JP); Jun Abe, Kanagawa (JP); Toshihiro Kanematsu, Kanagawa (JP); Kenta Urayama, Kanagawa (JP); Shinji Okuyama, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/610,174

(22) Filed: Jan. 30, 2015

(65) Prior Publication Data

US 2016/0085180 A1 Mar. 24, 2016

(30) Foreign Application Priority Data

Sep. 24, 2014 (JP) ..... 2014-193955

(51) Int. Cl.
*G03G 15/08* (2006.01)

(52) U.S. Cl.
CPC ..... *G03G 15/0891* (2013.01)

(58) Field of Classification Search
None
See application file for complete search history.

(56) References Cited

U.S. PATENT DOCUMENTS

| | | | | |
|---|---|---|---|---|
| 5,709,973 | A * | 1/1998 | Chen et al. | 430/124.33 |
| 6,104,894 | A * | 8/2000 | Sato | G03G 15/0942 399/106 |
| 2010/0129110 | A1* | 5/2010 | Kawaguchi | 399/104 |
| 2011/0064472 | A1 | 3/2011 | Sakurai | |
| 2013/0244166 | A1* | 9/2013 | Yamazaki et al. | 430/109.1 |

FOREIGN PATENT DOCUMENTS

JP 2011064856 A 3/2011

* cited by examiner

*Primary Examiner* — David Gray
*Assistant Examiner* — Sevan A Aydin
(74) *Attorney, Agent, or Firm* — Oliff PLC

(57) ABSTRACT

A transport mechanism includes: a container that stores a specific developer; a transport body that transports the developer in an axial direction of a shaft about which the transport body rotates in the container while stirring the developer; a bearing that supports the transport body such that the transport body is rotatable about the shaft; and a restricting portion that has a substantially annular shape and a maximum magnetic force of about 20 mT or greater and about 50 mT or smaller and restricts the transportation of the developer past the restricting portion by surrounding the shaft, the restricting portion being provided nearer to a side on which the transport body transports the developer than the bearing in the axial direction of the shaft.

5 Claims, 10 Drawing Sheets

FIG. 10

| DEVELOPER NO. | VOLUME MEAN PARTICLE SIZE OF TONER PARTICLES T (μm) | STORAGE MODULUS OF TONER PARTICLES T AT 40°C (Pa) | VOLUME MEAN PARTICLE SIZE OF CARRIER PARTICLES CA (μm) |
|---|---|---|---|
| DEVELOPER 1 | 3.6 | $2.0\times10^{8}$ | 23 |
| DEVELOPER 2 | 3.5 | $9.7\times10^{7}$ | 23 |
| DEVELOPER 3 | 3.5 | $1.1\times10^{8}$ | 23 |
| DEVELOPER 4 | 3.4 | $1.02\times10^{7}$ | 23 |
| DEVELOPER 5 | 3.4 | $9.8\times10^{6}$ | 23 |
| DEVELOPER 6 | 3.8 | $3.8\times10^{8}$ | 23 |
| DEVELOPER 7 | 3.9 | $4.1\times10^{8}$ | 23 |
| DEVELOPER 8 | 3.4 | $5.3\times10^{6}$ | 23 |
| DEVELOPER 9 | 3.9 | $4.8\times10^{8}$ | 23 |
| DEVELOPER 10 | 4.3 | $4.8\times10^{8}$ | 23 |
| DEVELOPER 11 | 4.8 | $2.0\times10^{8}$ | 23 |
| DEVELOPER 12 | 3.4 | $4.8\times10^{6}$ | 23 |
| DEVELOPER 13 | 4.3 | $5.2\times10^{8}$ | 23 |
| DEVELOPER 14 | 5.0 | $2.0\times10^{8}$ | 23 |

TRANSPORT MECHANISM, DEVELOPING DEVICE, AND IMAGE FORMING APPARATUS

CROSS-REFERENCE TO RELATED APPLICATIONS

This application is based on and claims priority under 35 USC 119 from Japanese Patent Application No. 2014-193955 filed Sep. 24, 2014.

BACKGROUND (i) Technical Field

The present invention relates to a transport mechanism, a developing device, and an image forming apparatus.

(ii) Related Art

There is a known transport mechanism including a transport body that is rotatably supported by bearings and is rotatable about a shaft, the transport body being configured to transport, while stirring, a developer containing toner particles and magnetic particles. Furthermore, there is a known technique in which an annular magnetic member having a maximum magnetic force of about 100 mT is provided around a shaft of a transport body, whereby the transportation of a developer past the magnetic member by the transport body is restricted.

If a specific developer defined below is transported by the above transport mechanism, toner particles contained in the developer may adhere to the shaft of the transport body. The specific developer referred to herein is defined as a developer containing toner particles having a volume mean particle size of 4.8 μm or about 4.8 μm or smaller and a storage modulus at 40° C. of $5.0\times10^6$ Pa or about $5.0\times10^6$ Pa or greater and $5.0\times10^8$ Pa or about $5.0\times10^8$ Pa or smaller, and magnetic particles having a volume mean particle size of 20 μm or about 20 μm or larger.

SUMMARY

According to an aspect of the invention, there is provided a transport mechanism including a container that stores a developer, the developer containing toner particles having a volume mean particle size of about 4.8 μm or smaller and a storage modulus at 40° C. of about $5.0\times10^6$ Pa or greater and about $5.0\times10^8$ Pa or smaller, and magnetic particles having a volume mean particle size of about 20 μm or larger; a transport body that transports the developer in an axial direction of a shaft about which the transport body rotates in the container while stirring the developer; a bearing that supports the transport body such that the transport body is rotatable about the shaft; and a restricting portion that has a substantially annular shape and a maximum magnetic force of about 20 mT or greater and about 50 mT or smaller and restricts the transportation of the developer past the restricting portion by surrounding the shaft, the restricting portion being provided nearer to a side on which the transport body transports the developer than the bearing in the axial direction of the shaft.

BRIEF DESCRIPTION OF THE DRAWINGS

An exemplary embodiment of the present invention will be described in detail based on the following figures, wherein:

FIG. 10 is a table summarizing the developer (Developer 1) according to the exemplary embodiment, other developers (Developers 2 to 11) according to working examples, and yet other developers (Developers 12 to 14) according to comparative examples.

DETAILED DESCRIPTION

Outline

An exemplary embodiment of the present invention will now be described with reference to the accompanying drawings. The description starts with the configuration and operation of an image forming apparatus as a whole, followed by featured elements (a developer, a transport mechanism, and a developing device including the transport mechanism) characterizing the exemplary embodiment, and tests conducted for evaluating the exemplary embodiment.

Figure 1:
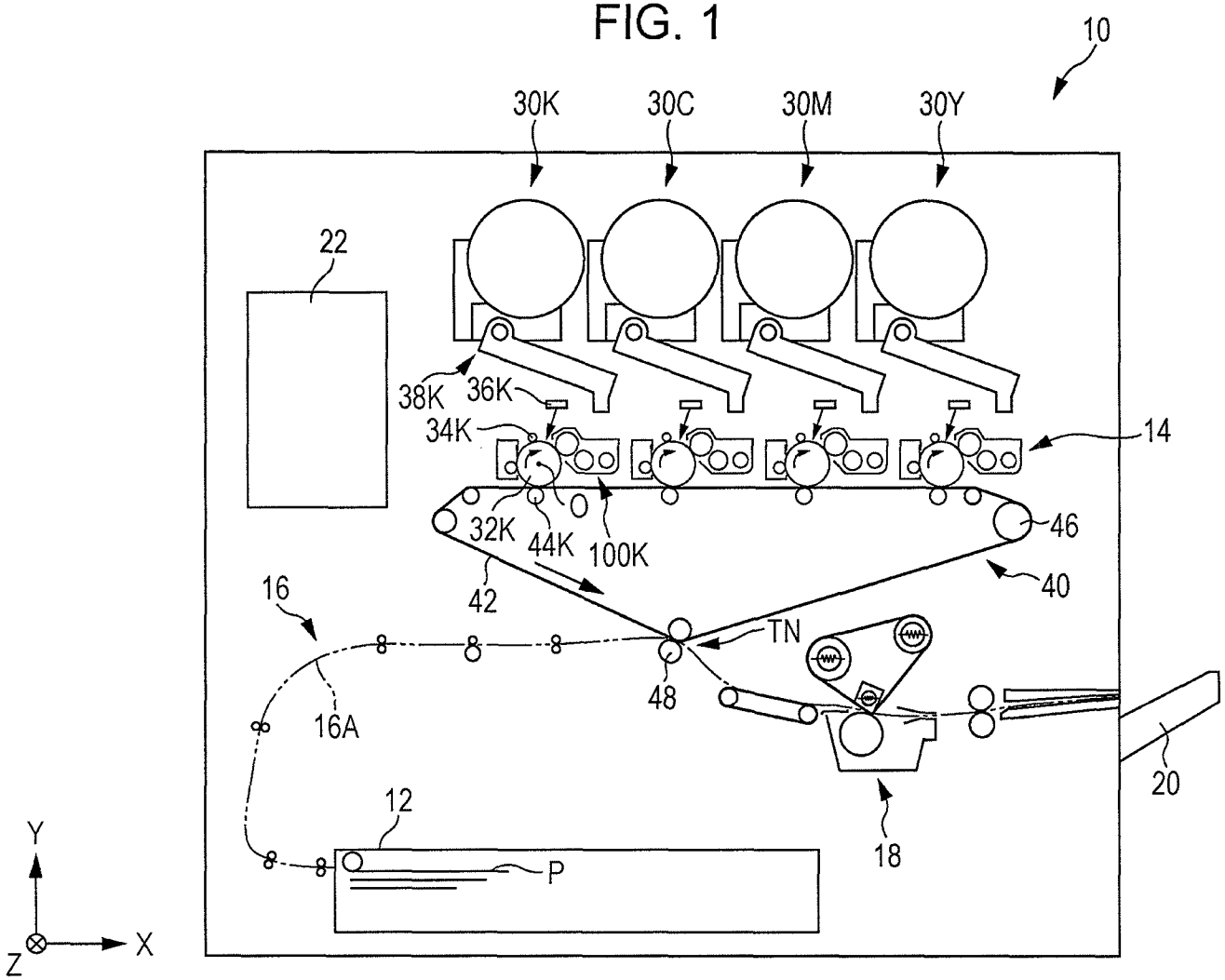
FIG. 1 is a schematic front view illustrating the entirety of an image forming apparatus according to the exemplary embodiment.

In each of the drawings to be referred to below, the direction indicated by arrow Y corresponds to an apparatus height direction, the direction indicated by arrow X corresponds to an apparatus width direction, and the direction that is orthogonal to both the apparatus height direction and the apparatus width direction (the direction indicated by arrow Z) corresponds to an apparatus depth direction. In FIG. 1, the front side of an image forming apparatus 10 corresponds to the near side in the apparatus depth direction.

Configuration of Image Forming Apparatus

The configuration of the image forming apparatus 10 as a whole will now be described with reference to FIG. 1. The image forming apparatus 10 includes a medium container 12, a multicolor image forming section 14, a medium transporting section 16, a fixing device 18, an output portion 20, and a controller 22.

Medium Container

The medium container 12 has a function of storing media P that are yet to undergo image formation.

Multicolor Image Forming Section

The multicolor image forming section 14 has a function of forming a multicolor toner image on a medium P. The multicolor image forming section 14 includes monochrome image forming units 30Y, 30M, 30C, and 30K, and a transfer unit 40. The transfer unit 40 is an exemplary transfer device. The suffixes Y, M, C, and K provided to the reference numerals stand for the respective colors of toner particles: yellow, magenta, cyan, and black, respectively. The term "multicolor toner image" refers to a toner image composed of toner particles having at least two of the four colors of Y (yellow), M (magenta), C (cyan), and K (black).

The monochrome image forming units 30Y, 30M, 30C, and 30K all have substantially the same configuration, except the kind of toner particles used. Therefore, in FIG. 1, reference numerals for elements included in the monochrome image forming units 30M, 30C, and 30K are omitted.

Monochrome Image Forming Units

The monochrome image forming units 30Y, 30M, 30C, and 30K have a function of forming toner images in the respective colors on respective photoconductors 32Y, 32M, 32C, and 32K to be described below. The monochrome image forming unit 30K includes the photoconductor 32K, a charging device 34K, an exposure device 36K, a developing device 100K, and a toner supplying device 38K. Likewise, the monochrome image forming units 30Y, 30M, and 30C include, in correspondence with the respective colors, the respective photoconductors 32Y, 32M, and 32C; respective charging devices 34Y, 34M, and 34C; respective exposure devices 36Y, 36M, and 36C; respective developing devices 100Y, 100M, and 100C; and respective toner supplying devices 38Y, 38M, and 38C. Now, the monochrome image forming units 30Y, 30M, 30C, and 30K and elements included therein will be described. The suffixes are omitted if there is no need to distinguish the elements by the colors.

Photoconductors

The photoconductors 32 each have a function of carrying, while rotating on its axis, a latent image formed by a corresponding one of the exposure devices 36. Each of the photoconductors 32 is an exemplary image carrying body. The expression "on its axis" means "on the axis of rotation of that element." In the case of the photoconductor 32, the expression means "on the axis of rotation of the photoconductor 32." This usage of the expression "on its axis" also applies to other relevant elements, as with the photoconductor 32. The axis of rotation is denoted by reference character O in the drawings.

Charging Devices

The charging devices 34 each have a function of charging a corresponding one of the photoconductors 32.

Exposure Devices

The exposure devices 36 each have a function of forming a latent image on a corresponding one of the photoconductors 32 that has been charged by a corresponding one of the charging devices 34.

Developing Devices

The developing devices 100 each have a function of developing a corresponding one of the latent images carried by a corresponding one of the photoconductors 32 into a toner image in a corresponding one of the colors with a corresponding one of developers G. The developing devices 100 and the respective developers G characterize the exemplary embodiment and will be described separately below.

Toner Supplying Devices

The toner supplying devices 38 each have a function of supplying a corresponding one of the kinds of toner particles T (see FIG. 4) to a corresponding one of the developing devices 100.

Transfer Unit

The transfer unit 40 has a function of transferring the toner images in the respective colors developed on the respective photoconductors 32 to a transfer belt 42 such that the toner image are superposed one on top of another (first transfer), and further transferring the superposition of toner images in the respective colors (hereinafter referred to as multicolor toner image) to a medium P (second transfer). The transfer unit 40 includes the transfer belt 42, first transfer rollers 44Y, 44M, 44C, and 44K, a driving roller 46, and a second transfer roller 48. The first transfer rollers 44Y, 44M, 44C, and 44K are provided in correspondence with the monochrome image forming units 30Y, 30M, 30C, and 30K.

Medium Transporting Section and Output Portion

The medium transporting section 16 has a function of transporting a medium P from the medium container 12 along a transport path 16A and ejecting the medium P onto the output portion 20.

Fixing Device

The fixing device 18 has a function of fixing the multicolor tone image, which has undergone the second transfer to the medium P performed by the transfer unit 40, to the medium P by applying heat and pressure thereto.

Controller

The controller 22 has a function of controlling operations performed by the individual elements of the image forming apparatus 10.

Operation of Image Forming Apparatus

An image forming operation performed by the image forming apparatus 10 will now be described with reference to FIG. 1.

When the controller 22 receives an image signal from an external apparatus (a computer, for example), the controller 22 converts the image signal into pieces of image data for the respective colors and outputs the pieces of image data to the respective exposure devices 36. In response to this, beams of exposure light are emitted from the respective exposure devices 36 and are applied to the respective photoconductors 32 charged by the respective charging devices 34, whereby latent images are formed on the respective photoconductors 32. The latent images are then developed into toner images in the respective colors by the respective developing devices 100. The toner images in the respective colors are then transferred to the transfer belt 42 for the first transfer by the respective first transfer rollers 44. Meanwhile, a medium P is transported to a nip TN in such a manner as to reach the nip TN when the portion of the transfer belt 42 where the multicolor toner image has been formed in the first transfer reaches the nip TN, whereby the multicolor toner image is transferred to the medium P for the second transfer. The medium P having the multicolor toner image that has undergone the second transfer is transported toward the fixing device 18, where the multicolor toner image is fixed to the medium P. Then, the medium P having the fixed multicolor toner image is ejected onto the output portion 20. Thus, the image forming operation ends.

Configurations of Featured Elements

The elements that characterize the exemplary embodiment will now be described with reference to associated drawings.

Developer

Figure 4:
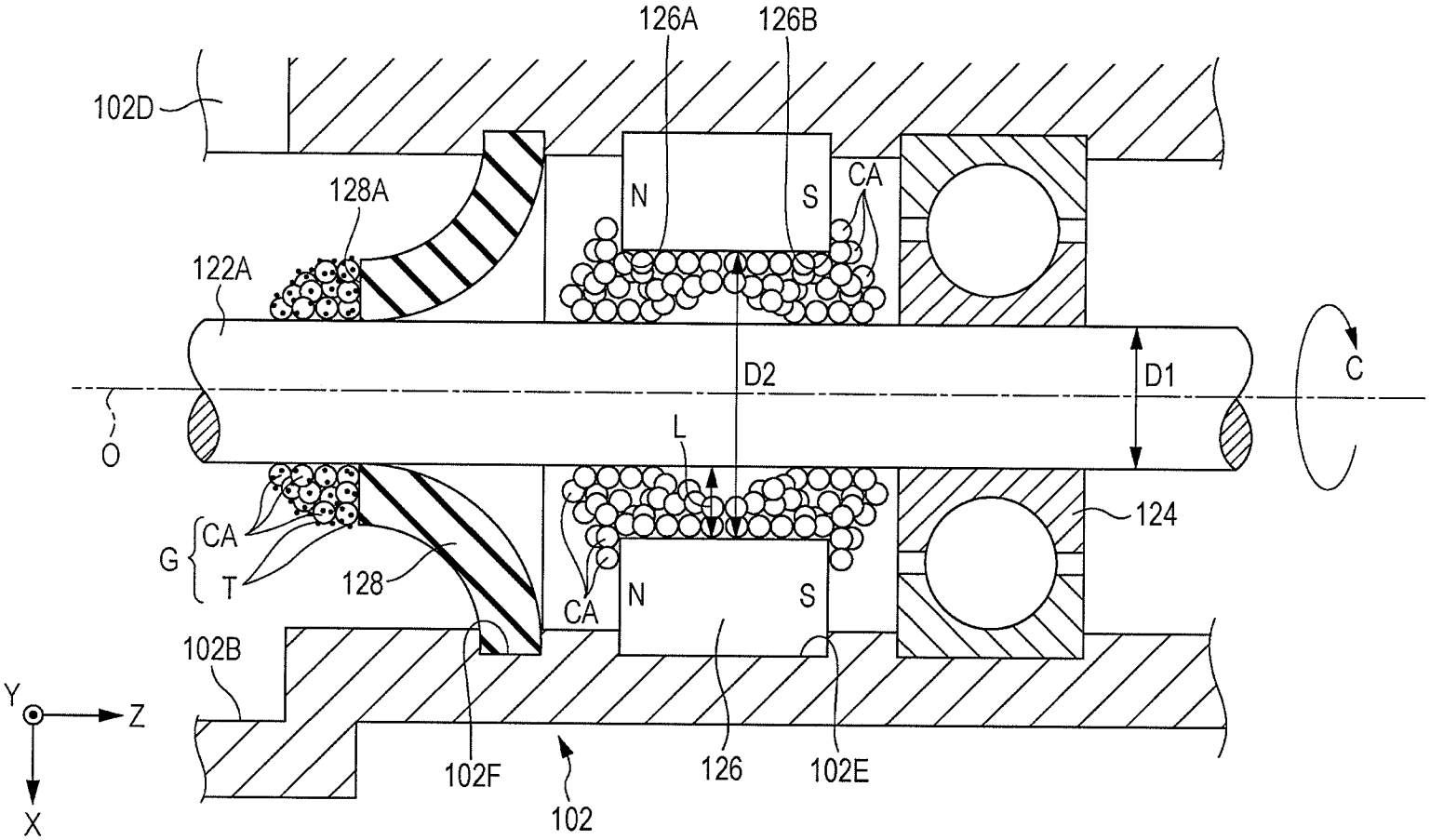
FIG. 4 is a schematic diagram illustrating a state where a developer is sealed in by a contact seal and a magnetic seal that are provided at an end of a stirring member according to the exemplary embodiment.

As illustrated in FIG. 4, the developers G used in the respective developing devices 100 each contain toner particles T and carrier particles CA. The carrier particles CA are exemplary magnetic particles. The toner particles T according to the exemplary embodiment have, for example, a volume mean particle size of 3.6 μm and a storage modulus at 40° C. of $2.0\times10^8$ Pa. The carrier particles CA according to the exemplary embodiment have a volume mean particle size of 23 μm. The developer G according to the exemplary embodiment contains, for example, an additive (not illustrated), in addition to the toner particles T and the carrier particles CA. That is, the developer G according to the exemplary embodiment is an exemplary developer (the specific developer) containing toner particles having a volume mean particle size of 4.8 μm or about 4.8 μm or smaller and a storage modulus at 40° C. of $5.0\times10^6$ Pa or about $5.0\times10^6$ Pa or greater and $5.0\times10^8$ Pa or about $5.0\times10^8$ Pa or smaller, and magnetic particles having a volume mean particle size of 20 μm or about 20 μm or larger. In the following description, the term "developer G" refers to the specific developer defined as above.

Developing Device

Figure 2:
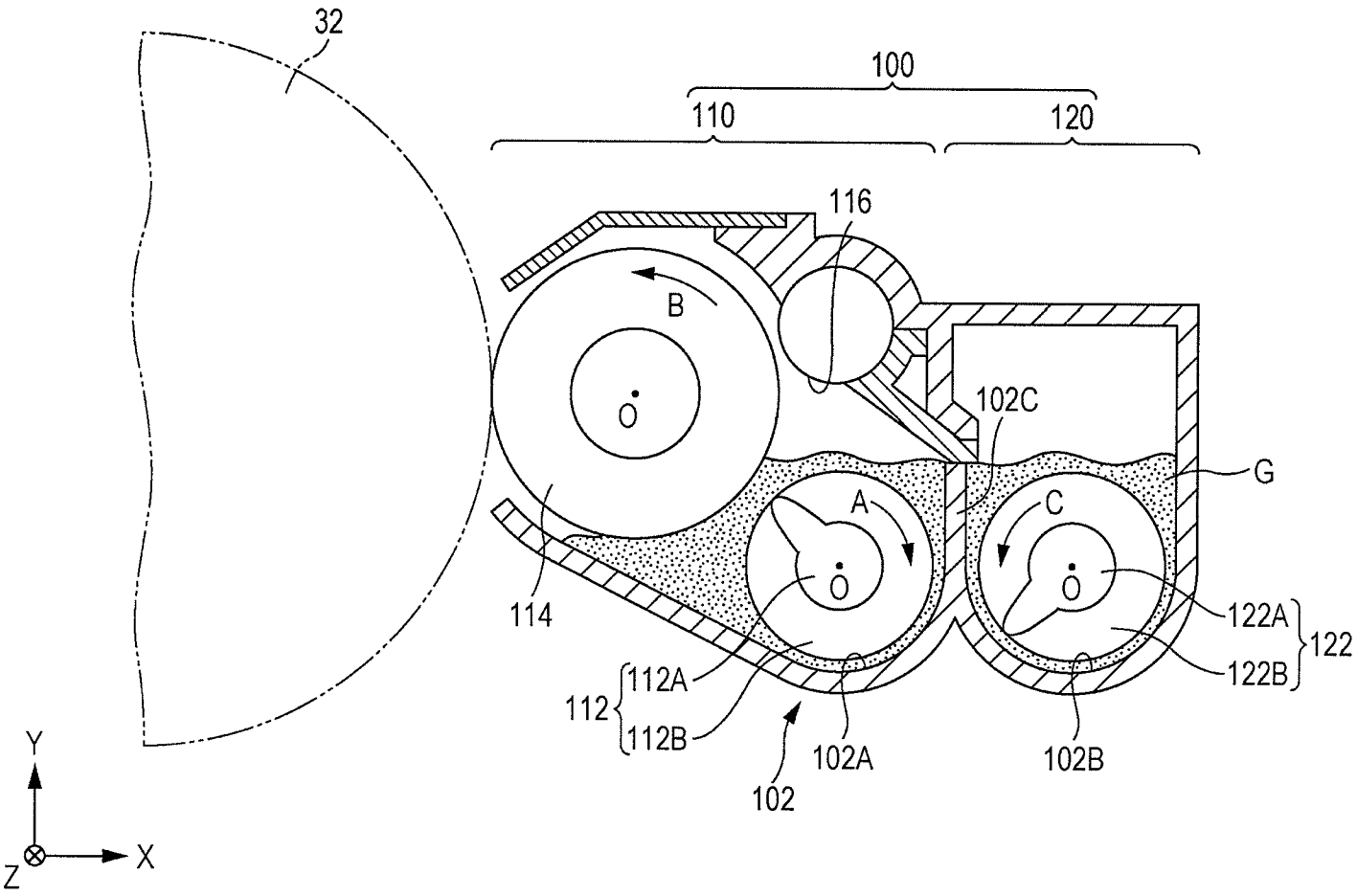
FIG. 2 is a sectional front view of a developing device included in the image forming apparatus according to the exemplary embodiment.
Figure 3:
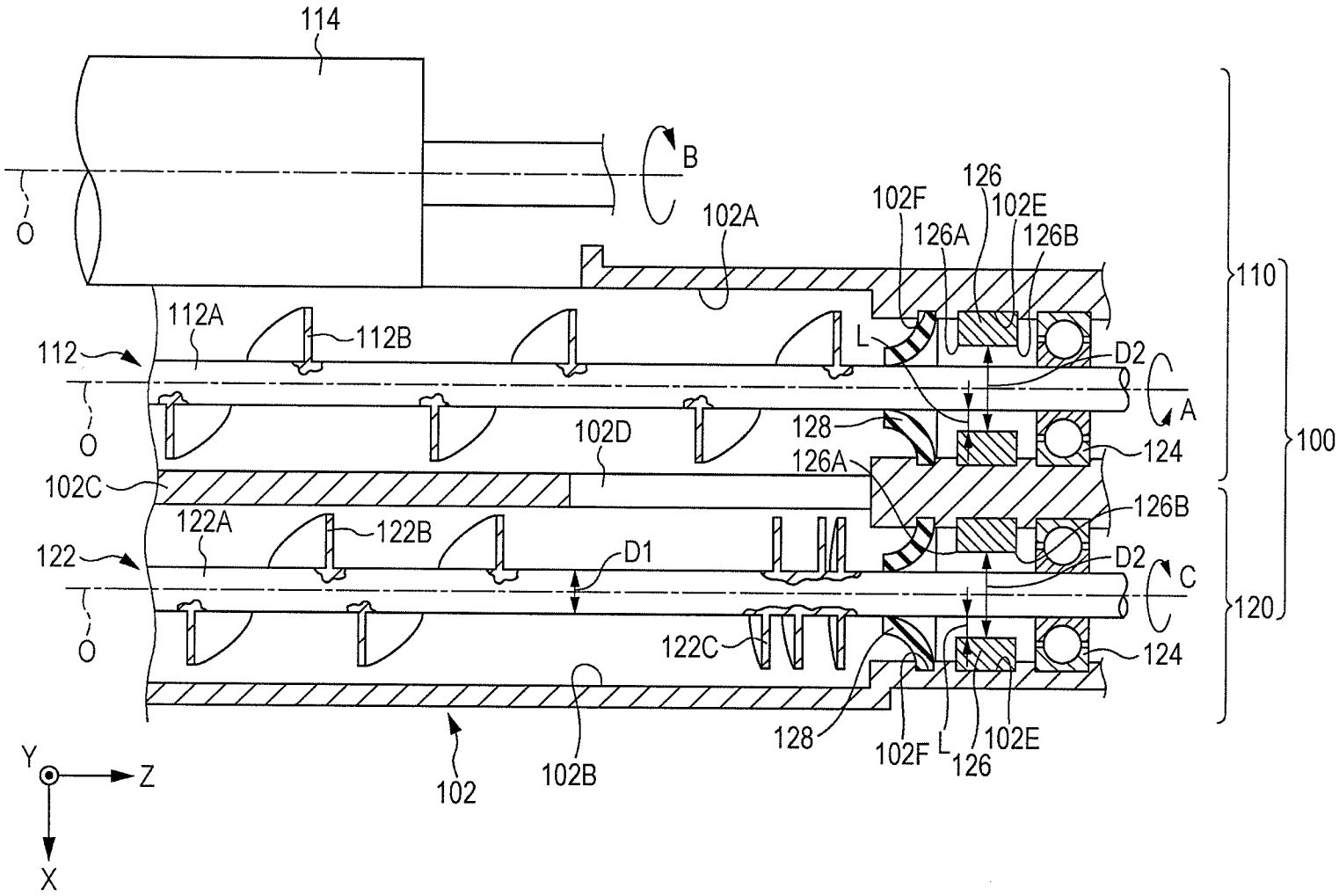
FIG. 3 is a sectional top view illustrating a portion of the developing device included in the image forming apparatus according to the exemplary embodiment.

As illustrated in FIGS. 2 and 3, the developing devices 100 each include a developing portion 110 and a stirring portion 120. The developing portion 110 and the stirring portion 120 include respectively different portions of a case 102. Elements included in the developing portion 110 and in the stirring portion 120 excluding the above portions of the case 102 are housed in the case 102. The developing portion 110 and the stirring portion 120 are included in an exemplary transport mechanism. The case 102 is an exemplary container. A space defined by the portion of the case 102 in which the elements of the developing portion 110 are provided is referred to as development chamber 102A. A space defined by the other portion of the case 102 and in which the elements of the stirring portion 120 are provided is referred to as stirring chamber 102B.

FIG. 3 is a sectional top view illustrating a portion of the developing device 100 that is on the far side in the apparatus depth direction. Each of the developing portion 110 and the stirring portion 120 includes, at one end thereof illustrated in FIG. 3, a contact seal 128, a magnetic seal 126, and a bearing 124, all of which will be described separately below, provided in that order from the near side toward the far side in the apparatus depth direction. A portion of the developing device 100 that is on the near side in the apparatus depth direction (the portion being not illustrated) has a configuration that is symmetrical to the portion of the developing device 100 that is on the far side in the apparatus depth direction. That is, in each of the developing portion 110 and the stirring portion 120, the contact seal 128, the magnetic seal 126, and the bearing 124 are provided in that order from the center toward each of two ends in the axial direction of a corresponding one of a supply member 112 and a stirring member 122, which will be described separately below.

Developing Portion

The developing portion 110 has a function of delivering to the photoconductor 32 the developer G that has been stirred and transported thereto by the stirring portion 120. The developing portion 110 includes the portion of the case 102, the supply member 112, a developing roller 114, and a trimmer bar 116. The supply member 112 is an exemplary transfer body. The developing roller 114 is an exemplary delivering member. The supply member 112, the developing roller 114, and the trimmer bar 116 are each a long member extending in the apparatus depth direction and are all provided in the development chamber 102A.

As illustrated in FIGS. 2 and 3, the supply member 112 includes a rotating shaft 112A and a helical portion 112B provided around the rotating shaft 112A and having a helical shape. The rotating shaft 112A is an exemplary shaft. The supply member 112 is driven by a driving source (not illustrated) provided in the image forming apparatus 10 and is thus rotatable on its axis (in a direction of arrow A). When the supply member 112 rotates on its axis, the supply member 112 transports the developer G in the development chamber 102A with the aid of the helical portion 112B from the far side toward the near side in the apparatus depth direction, i.e., in the axial direction of the rotating shaft 112A, and thus supplies some of the developer G to the developing roller 114. The supply member 112 is a nonmagnetic member.

The developing roller 114 faces the photoconductor 32 in one portion thereof and faces the supply member 112 in another portion thereof. The developing roller 114 is driven by the above driving source and is thus rotatable on its axis (in a direction of arrow B). The trimmer bar 116 faces the developing roller 114 at a position on the downstream side in the direction of arrow B with respect to the position where the developing roller 114 faces the supply member 112 and on the upstream side in the direction of arrow B with respect to the position where the developing roller 114 faces the photoconductor 32. The developing roller 114 receives the some developer G from the supply member 112 while rotating on its axis and delivers to the photoconductor 32 a layer of developer G whose thickness has been adjusted by the trimmer bar 116.

The case 102 has a wall 102C that separates the development chamber 102A and the stirring chamber 102B from each other. The wall 102C has openings 102D at two ends thereof in the apparatus depth direction. The supply member 112 transports the remaining developer G that has not been supplied to the developing roller 114 toward the end of the rotating shaft 112A that is on the near side in the apparatus depth direction, i.e., in the axial direction of the rotating shaft 112A. The developer G thus transported in the axial direction of the rotating shaft 112A by the supply member 112 is then delivered into the stirring chamber 102B through the opening 102D.

Stirring Portion

The stirring portion 120 has a function of transporting the developer G in the stirring chamber 102B while stirring the developer G. The stirring portion 120 has an opening (not illustrated) on the upper side thereof. As illustrated in FIG. 1, toner particles T are supplied to the stirring portion 120 from a corresponding one of the toner supplying devices 38 that is provided above the stirring portion 120.

As illustrated in FIGS. 2 and 3, the stirring portion 120 includes the portion of the case 102, the stirring member 122, the bearings 124, the magnetic seals 126, and the contact seals 128. The stirring member 122 has a long shape extending in the apparatus depth direction in the stirring chamber 102B. The magnetic seals 126 according to the exemplary embodiment are each a permanent magnet, for example. The stirring member 122 is an exemplary transport body. The bearings 124 are each an exemplary bearing. The magnetic seals 126 are each an exemplary restricting portion. The contact seals 128 are each an exemplary fitting portion.

Stirring Member

As illustrated in FIG. 3, the stirring member 122 includes a rotating shaft 122A having a diameter D1, and helical portions 122B and 122C provided around the rotating shaft 122A and each having a helical shape. The rotating shaft 122A is an exemplary shaft. As illustrated in FIG. 3, each of two ends of the stirring member 122 is supported by a corresponding one of the bearings 124 that are fitted in grooves 102E provided in the case 102, whereby the stirring member 122 is rotatable about the rotating shaft 122A. The bearings 124 according to the exemplary embodiment are, for example, antifriction bearings. In FIG. 3, a portion of the stirring member 122 that is on the near side in the apparatus depth direction is not illustrated, and the bearing 124 provided on the near side in the apparatus depth direction is therefore not illustrated.

The helical portion 122B is provided over the entirety, excluding the two ends, of the rotating shaft 122A in the axial direction of the rotating shaft 122A (see FIG. 3). On the other hand, the helical portion 122C is helical in a direction opposite to a direction in which the helical portion 122B is helical. The helical portion 122C is provided at a position nearer to the helical portion 122B (i.e., nearer to a side on which the stirring member 122 transports the developer G) than the position where the rotating shaft 122A is supported by the bearing 124, and next to the opening 102D in the apparatus width direction.

The stirring member 122 is driven by the above driving source that also drives the supply member 112, and is thus rotatable on its axis (in a direction of arrow C). When the stirring member 122 rotates on its axis, the stirring member 122 transports, while stirring, the developer G in the stirring chamber 102B with the aid of the helical portion 122B from the near side toward the far side in the apparatus depth direction, i.e., in the axial direction of the rotating shaft 122A. Furthermore, the stirring member 122 brakes, with the aid of the helical portion 122C, the transportation of the developer G that has been transported in the axial direction of the rotating shaft 122A. The developer G the transportation of which has been braked by the helical portion 122C is delivered into the development chamber 102A through the opening 102D. The stirring member 122 is a nonmagnetic member. In the case where the stirring member 122 is driven by the above driving source, the stirring member 122 rotates on its axis at a speed of, for example, 600 revolutions per minute.

As described above, some of the developer G that has been delivered from the stirring chamber 102B into the development chamber 102A is supplied to the developing roller 114 by the supply member 112. The remaining developer G excluding the some developer G circulates between the development chamber 102A and the stirring chamber 102B through the openings 102D.

Magnetic Seal

The magnetic seals 126 each have a function of restricting the transportation of the developer G that has been transported thereto by the helical portion 122B of the stirring member 122.

As illustrated in FIGS. 3 and 4, the magnetic seal 126 is a magnet having an annular or substantially annular shape. The inside diameter of the magnetic seal 126 is defined as D2. The outer periphery of the magnetic seal 126 is fitted in the groove 102E provided in the case 102. The magnetic seal 126 is provided between the bearing 124 and the helical portion 122B and surrounds the rotating shaft 122A. The axis of the magnetic seal 126 coincides with the axis of the rotating shaft 122A. In the exemplary embodiment, a gap L between the magnetic seal 126 and the rotating shaft 122A ($=\frac{1}{2}\times(D2-D1)$) is, for example, 500 μm.

The magnetic seal 126 has the north (N) pole on a side thereof facing the helical portion 122B and the south (S) pole on a side thereof facing the bearing 124. Therefore, the magnetic seal 126 produces a magnetic field acting in a direction from the side thereof facing the helical portion 122B toward the side thereof facing the bearing 124. The magnetic flux density of the magnetic seal 126 is highest at an inner circumferential edge 126A on the N-pole side and at an inner circumferential edge 126B on the S-pole side. The magnetic force at each of the inner circumferential edges 126A and 126B is 50 mT. That is, the maximum magnetic force of the magnetic seal 126 is 50 mT. The magnetic force is measured with the magnetic seal 126 yet to be fitted in the groove 102E of the case 102, that is, the magnetic force of the magnetic seal 126 alone is measured, with a gauss meter.

The magnetic seal 126 catches with its magnetic force the carrier particles CA that have been transported by the stirring member 122 and have gone past a point of contact (represented by a dash-dot-dot line in FIG. 4) between the contact seal 128, to be described below, and the rotating shaft 122A, whereby the magnetic seal 126 restricts the further transportation of the carrier particles CA. The magnetic seal 126 also electrostatically attracts toner particles T that have gone past the point of contact between the contact seal 128 and the rotating shaft 122A to the carrier particles CA that have been caught by the magnetic seal 126 with the magnetic force. Thus, the magnetic seal 126 restricts the further transportation of the toner particles T. With such a mechanism, the magnetic seal 126 restricts the transportation of the developer G so that the developer G does not reach the bearing 124.

Contact Seal

The contact seal 128 has a function of restricting the transportation of the toner particles T transported by the helical portion 122B of the stirring member 122.

As illustrated in FIGS. 3 and 4, the contact seal 128 is a disc-shaped elastic body having a through hole 128A. The through hole 128A of the contact seal 128 that is in a free state has a diameter smaller than the diameter of the rotating shaft 122A. The outer periphery of the contact seal 128 is fitted in a groove 102F provided in the case 102. The contact seal 128 is fitted on the rotating shaft 122A while being elastically deformed toward a side opposite the bearing 124 with respect to the magnetic seal 126 in the apparatus depth direction, i.e., toward the side on which the stirring member 122 transports the developer G. In the state where the contact seal 128 is fitted on the rotating shaft 122A while being elastically deformed, the end facet of the contact seal 128 that defines the through hole 128A faces toward the helical portion 122B. Furthermore, an area of the contact seal 128 that is on one side and extends along the entire circumference of the through hole 128A is pressed against the rotating shaft 122A over the entire circumference of the rotating shaft 122A.

Additional Description of Developing Portion

As illustrated in FIG. 3, the developing portion 110 includes the bearings 124, the magnetic seals 126, and the contact seals 128, which have not been described in detail in the above description of the developing portion 110. Two ends of the supply member 112 (the rotating shaft 112A) are supported by the respective bearings 124 fitted in respective grooves 102E provided in the case 102. The magnetic seals 126 are each provided at a position nearer to the helical portion 112B than a corresponding one of the bearings 124 in such a manner as to surround a corresponding one of the two ends of the rotating shaft 112A. The contact seals 128 are each fitted on a corresponding one of the two ends of the rotating shaft 112A while being elastically deformed toward a side opposite the bearing 124 with respect to the magnetic seal 126, i.e., toward a side on which the supply member 112 transports the developer G.

The magnetic seals 126 included in the developing portion 110 restrict the transportation of the carrier particles CA of the developer G in the development chamber 102A. The contact seals 128 included in the developing portion 110 also restrict the transportation of the toner particles T of the developer G in the development chamber 102A.

The elements that characterize the exemplary embodiment are configured as described above.

Evaluation

Five durability tests conducted for evaluating the exemplary embodiment will now be described. Among the following results of the durability tests, those obtained with magnetic seals 126 each having a maximum magnetic force of 20 mT, 30 mT, or 50 mT are based on the exemplary embodiment, and those obtained with magnetic seals 126 each having a maximum magnetic force of 10 mT, 60 mT, 70 mT, or 100 mT are based on comparative embodiments. Any of the elements included in the developing device 100 according to the exemplary embodiment that are used in the durability tests are referred to as and denoted by the terms and reference numerals used in the description of the exemplary embodiment.

Durability Test Method

In each of the durability tests, a developing device 100 that is conditioned for each of the tests described below is attached to the image forming apparatus 10, and printing is performed continuously for two hours on 5% of the entire printable area of each of A4-size pieces of plain paper.

Evaluation 1

Outline

In Evaluation 1, plural developing devices 100 are prepared, with magnetic seals 126 of respective stirring portions 120 having different maximum magnetic forces. The maximum magnetic forces of the magnetic seals 126 prepared are 10 mT, 20 mT, 50 mT, 60 mT, 70 mT, and 100 mT, respectively. Evaluation 1 is conducted with different levels of toner concentration (hereinafter abbreviated to TC, which is the percentage of the weight of the toner particles T to the weight of the developer G) in each of regions of the stirring portions 120 that are surrounded by the magnetic seals 126. Specifically, the levels of TC are 5%, 10%, 15%, and 20%.

In Evaluation 1, after the durability test is conducted, each of the developing devices 100 is detached from the image forming apparatus 10. Furthermore, the stirring member 122 is detached from the developing device 100. Then, the length, in the axial direction of the rotating shaft 122A, of a band of toner particles T (hereinafter referred to as "band width") adhered to the region of the rotating shaft 122A of the stirring member 122 that is surrounded by the magnetic seal 126 is measured.

Results

Figure 5:
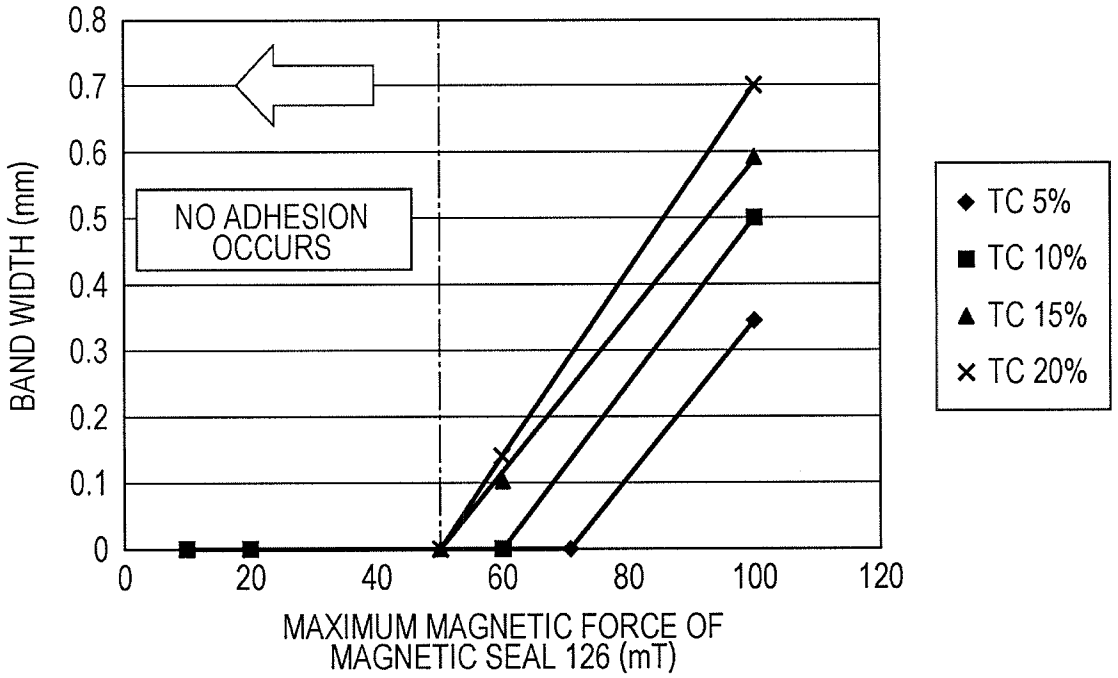
FIG. 5 is a graph illustrating the results of Evaluation 1 on the basis of the relationship between the maximum magnetic force of the magnetic seal and the width of a band of toner particles (the band width) adhered to a rotating shaft of the stirring member.

In each of the cases of the magnetic seals 126 having the maximum magnetic forces greater than 50 mT, it is found that the band width is longer than 0 mm as graphed in FIG. 5, that is, some toner particles T adhere to the rotating shaft 122A. Particularly, comparing the cases of the magnetic seals 126 having the same maximum magnetic force, the higher the TC, the longer the band width.

In contrast, in each of the cases of the magnetic seals 126 having the maximum magnetic forces of 50 mT or smaller, it is found that the band width is 0 mm, that is, no toner particles T adhere to the rotating shaft 122A.

Review of Results

As described above, if a magnetic seal 126 having a maximum magnetic force greater than 50 mT is used, some toner particles T adhere to the rotating shaft 122A, regardless of the level of the TC. Now, a mechanism in which toner particles T adhere to the rotating shaft 122A will be described with reference to FIG. 4. FIG. 4 is only a schematic diagram, and the developer G and other associated elements are not necessarily to scale, for easy understanding.

Mechanism of Adhesion of Toner Particles T to Rotating Shaft 122A

In the stirring portion 120, the developer G that has been transported toward the far side in the apparatus depth direction by the stirring member 122 is restricted not to reach a side farther than the contact seal 128 (the side of the magnetic seal 126), that is, not to go past the contact seal 128. Nevertheless, some of the developer G may go through the point of contact between the contact seal 128 and the rotating shaft 122A (represented by the dash-dot-dot line in FIG. 4) and may advance toward the far side. If carrier particles CA contained in the developer G that has advanced toward the far side reach the region surrounded by the magnetic seal 126, the carrier particles CA are subject to the magnetic force exerted by the magnetic seal 126 and are caught by the magnetic seal 126. Thus, the carrier particles CA that have reached the region surrounded by the magnetic seal 126 are restricted not to go past the magnetic seal 126 and are therefore not likely to reach the bearing 124. FIG. 4 illustrates carrier particles CA near the magnetic seal 126 that are caught by the magnetic seal 126.

If toner particles T contained in the developer G that has advanced toward the far side reach the region surrounded by the magnetic seal 126, the toner particles T are subject to the electrostatic force exerted by the carrier particles CA and are (electrostatically) attracted to the carrier particles CA. Therefore, the toner particles T that have reached the region surrounded by the magnetic seal 126 are restricted not to go past the magnetic seal 126 and are therefore not likely to reach the bearing 124.

Among the carrier particles CA that are caught by the magnetic seal 126 and are continuously distributed from the magnetic seal 126 to the rotating shaft 122A, some carrier particles CA that are in contact with the rotating shaft 122A are subject to a frictional force produced on the rotating shaft 122A rotating on its axis. Therefore, the carrier particles CA distributed from the magnetic seal 126 to the rotating shaft 122A while being bound to one another with the magnetic force repeatedly come into contact with one another and move away from one another. Toner particles T that are electrostatically attracted to the carrier particles CA collide with and are squeezed among the carrier particles CA while the carrier particles CA repeatedly come into contact with and move away from one another. Consequently, such toner particles T may be deformed and torn, and may adhere to the rotating shaft 122A.

Such adhesion of toner particles T to the rotating shaft 122A is considered to be more pronounced with the following factors.

Greatness of Maximum Magnetic Force of Magnetic Seal 126

As graphed in FIG. 5, in the cases where the maximum magnetic force of the magnetic seal 126 is greater than 50 mT, the adhesion of toner particles T to the rotating shaft 122A increases as the maximum magnetic force of the magnetic seal 126 increases. The greater maximum magnetic force the magnetic seal 126 has, the greater magnetic force the carrier particles CA receive from the magnetic seal 126. Therefore, such carrier particles CA collide with toner particles T with greater forces, and the toner particles T are squeezed among the carrier particles CA with greater forces. Consequently, such toner particles T may be deformed and torn to more extent, and may adhere to the rotating shaft 122A.

High TC

As graphed in FIG. 5, in the cases where the maximum magnetic force of the magnetic seal 126 is greater than 50 mT, the adhesion of toner particles T to the rotating shaft 122A increases as the TC increases. The high TC referred to herein means that there are many toner particles T in the region surrounded by the magnetic seal 126. Such a situation increases the frequency of collision between toner particles T and carrier particles CA and the frequency of squeezing of toner particles T by carrier particles CA. Consequently, such toner particles T may be deformed, torn, and adhere to the rotating shaft 122A.

Volume Mean Particle Size of Toner Particles T

As described above, the toner particles T according to the exemplary embodiment have a volume mean particle size of 3.6 μm and a storage modulus at 40° C. of $2.0\times10^8$ Pa. Evaluation 1 is conducted with toner particles that are the same as the toner particles T according to the exemplary embodiment except the volume mean particle size thereof (the toner particles used in Evaluation 1 have a volume mean particle size of 5.8 μm). In Evaluation 1, no toner particles adhere to the rotating shaft 122A (not graphed), regardless of the maximum magnetic force of the magnetic seal 126. That is, it is presumed that the adhesion of toner particles T to the rotating shaft 122A may occur if the volume mean particle size of the toner particles is smaller than 5.8 μm, as in the case of the toner particles T according to the exemplary embodiment.

Summary

According to the above review, in the case where the developer G according to the exemplary embodiment is transported, the adhesion of toner particles T to the rotating shaft 122A is less likely to occur in the stirring portion 120 according to the exemplary embodiment than in a transport portion including a magnetic seal having a maximum magnetic force greater than 50 mT. Consequently, in the developing device 100 according to the exemplary embodiment, the occurrence of defective development due to the adhesion of toner particles T to the rotating shaft 122A is suppressed. Accordingly, in the image forming apparatus 10 according to the exemplary embodiment, the occurrence of defective image formation due to the defective development is suppressed. The defective development due to the adhesion of toner particles T to the rotating shaft 122A occurs because of defective adjustment of the thickness of the layer of developer G that is performed by the trimmer bar 116. The defective adjustment of the thickness of the layer of developer G occurs because clots of toner particles T that have adhered to the rotating shaft 122A come off the rotating shaft 122A. The defective development due to the adhesion of toner particles T to the rotating shaft 122A may also be caused by defective transportation of the developer G by the stirring member 122 that is caused by defective rotation of the stirring member 122.

Evaluation 2

Outline

In Evaluation 2, after the durability test is conducted, the amount of developer G that has leaked through the magnetic seal 126 toward the side of the bearing 124 (hereinafter referred to as the amount of leakage) is measured. The amount of leakage referred to herein is calculated through the division of the total amount of developer G that has leaked in two hours, for which the durability test is continued, by unit time.

Results

Figure 6:
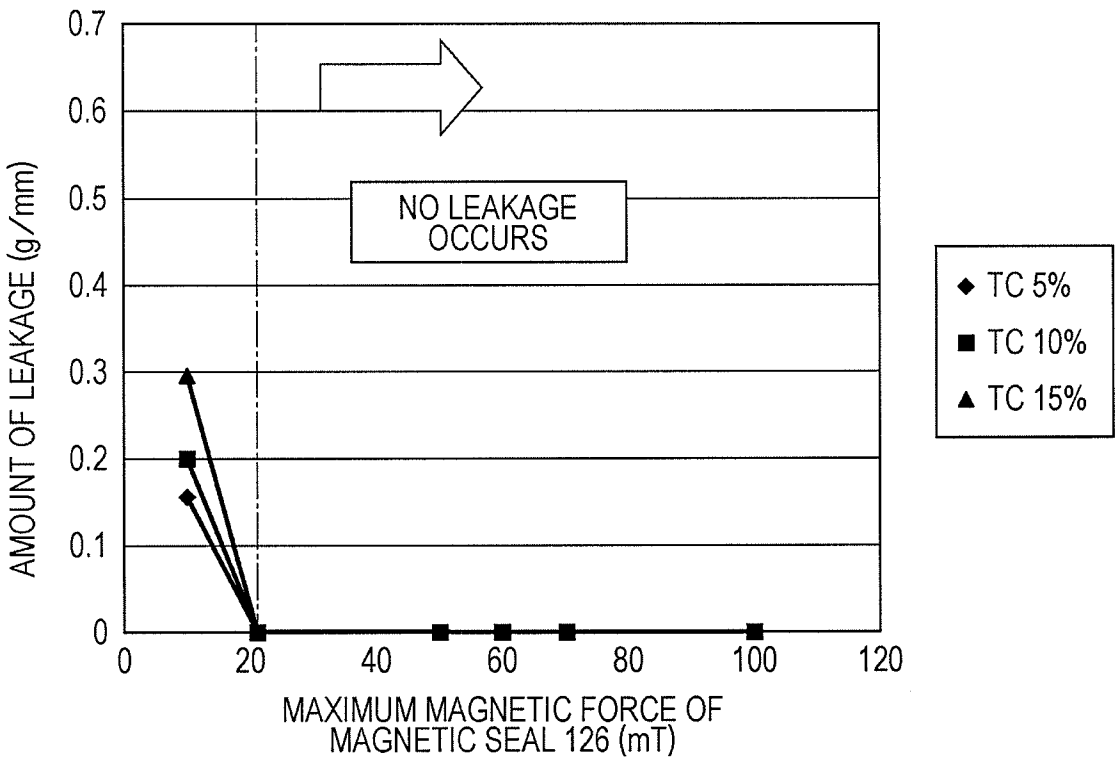
FIG. 6 is a graph illustrating the results of Evaluation 2 on the basis of the relationship between the maximum magnetic force of the magnetic seal and the amount of toner leakage (the amount of leakage) to a side nearer to an end of the rotating shaft of the stirring member than the magnetic seal in the axial direction of the rotating shaft.

In each of the cases of the magnetic seals 126 having the maximum magnetic forces smaller than 20 mT, the leakage of toner particles T occurs as graphed in FIG. 6. Particularly, comparing the cases of the magnetic seals 126 having the same maximum magnetic force, the higher the TC, the larger the amount of leakage.

In contrast, in each of the cases of the magnetic seals 126 having the maximum magnetic forces of 20 mT or greater, the amount of leakage is 0, that is, no leakage of toner particles T occurs.

Review of Results

As described above, in each of the cases of the magnetic seals 126 having the maximum magnetic forces smaller than 20 mT, it is presumed that the leakage of the developer G occurs at any TC because the magnetic force for catching the carrier particles CA is small. In addition, as the TC becomes higher, the amount of leakage tends to increase. This is probably because the magnetic forces exerted by the carrier particles CA are weakened because a large amount of toner particles T are electrostatically attracted to the carrier particles CA.

Hence, in the case where the developer G according to the exemplary embodiment is transported, the developer G is less likely to leak through the magnetic seal 126 toward the side of the bearing 124 in the stirring portion 120 according to the exemplary embodiment than in a transport portion including a magnetic seal having a maximum magnetic force smaller than 20 mT. If any portion of the developer G reaches the bearing 124, the function of the bearing 124 as a bearing is deteriorated, of course.

Additional Review of Evaluations 1 and 2

The contact seal 128 of the stirring portion 120 according to the exemplary embodiment is fitted on the rotating shaft 122A while being elastically deformed toward the side opposite the bearing 124 with respect to the magnetic seal 126 in the apparatus depth direction (toward the side on which the stirring member 122 transports the developer G). The developer G that has been transported in the axial direction of the rotating shaft 122A by the stirring member 122 is restricted not to reach a side farther than the contact seal 128 (the side of the magnetic seal 126) that is, not to go past the contact seal 128.

Thus, the stirring portion 120 according to the exemplary embodiment reduces the TC in the region surrounded by the magnetic seal 126. Therefore, the amount of leakage of the developer G is smaller and the toner particles T are less likely to adhere to the rotating shaft 122A in the stirring portion 120 according to the exemplary embodiment than in a stirring portion that does not include the contact seal 128 at a position nearer to the side where the developer G is transported than the magnetic seal 126.

Evaluation 3

Outline

In Evaluation 3, after the durability test is conducted, the band width of toner particles T adhered to the region of the rotating shaft 122A of the stirring member 122 that is surrounded by the magnetic seal 126 is measured for each of toner particles having a glass transition point of 50° C. or about 50° C. (hereinafter referred to as 50° C. toner) and toner particles having a glass transition point of 65° C. or about 65° C. (hereinafter referred to as 65° C. toner). In Evaluation 3, plural magnetic seals 126 having maximum magnetic forces of 30 mT, 60 mT, and 70 mT, respectively, are prepared. The TC is set to 5%. The 50° C. toner and the 65° C. toner both have a volume mean particle size of 3.6 μm and a storage modulus at 40° C. of $5.0\times10^6$ Pa or greater and $5.0\times10^8$ Pa or smaller.

Results

Figure 7:
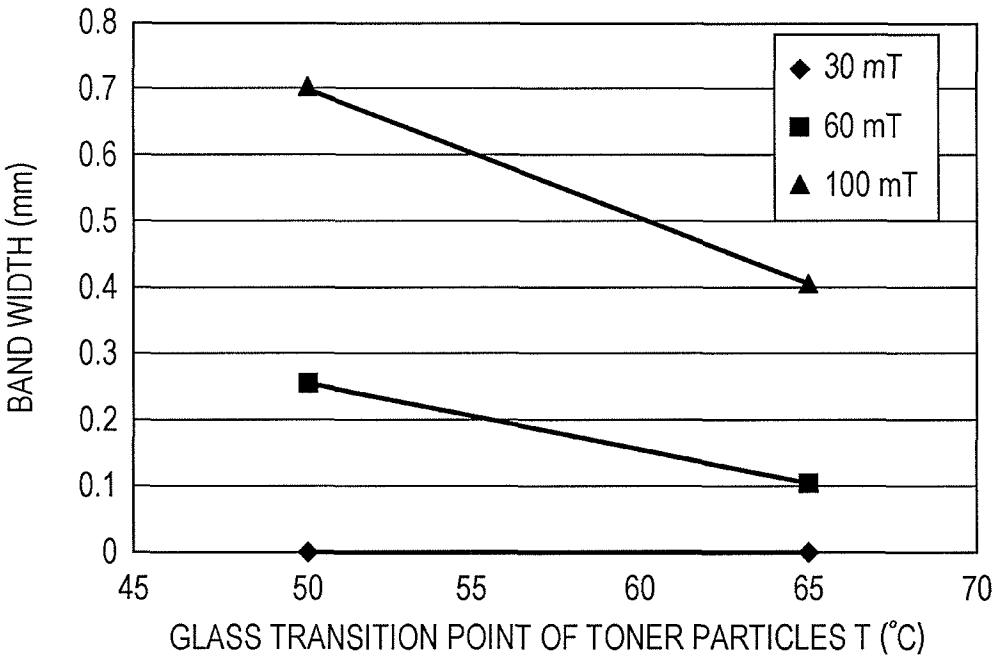
FIG. 7 is a graph illustrating the results of Evaluation 3 on the basis of the relationship between the glass transition point of the toner particles and the width of the band of toner particles (the band width) adhered to the rotating shaft of the stirring member.

In each of the cases of the magnetic seals 126 having the maximum magnetic forces of 60 mT and 100 mT, respectively, that is, in each of comparative embodiments, both of the toners (the 50° C. toner and the 65° C. toner) adhere to the rotating shaft 122A as graphed in FIG. 7. Particularly, comparing the cases of the magnetic seals 126 having the same maximum magnetic force, the lower the glass transition point, the larger the band width.

In contrast, in the case of the magnetic seal 126 having the maximum magnetic force of 30 mT, that is, in the exemplary embodiment, no toner particles T adhere to the rotating shaft 122A.

Review of Results

In the comparative embodiments, the lower the glass transition point of the toner particles T, the larger the band width. This is because of the following reason. The lower the glass transition point of the toner particles T, the softer the toner particles T. Therefore, when toner particles T in the region surrounded by the magnetic seal 126 collide with carrier particles CA or are squeezed among carrier particles CA, such toner particles T tend to be torn, that is, the toner particles T tend to be broken into small pieces. Consequently, such small pieces of toner particles T tend to adhere to the rotating shaft 122A. In addition, there is a correlation between the glass transition point of the toner particles T and the storage modulus of the toner particles T. Specifically, as the glass transition point of the toner particles T becomes lower, the storage modulus of the toner particles T becomes smaller.

Hence, in the case where the developer G according to the exemplary embodiment is transported, the adhesion of toner particles T to the rotating shaft 122A is less likely to occur in the stirring portion 120 according to the exemplary embodiment than in the transport portion according to any of the comparative embodiments.

Evaluation 4

Outline

In Evaluation 4, the amount of leakage of the developer G is measured for each of gaps L between the magnetic seal 126 and the rotating shaft 122A of 500 μm, 100 μm, and 1500 μm. In Evaluation 4, the TC is set to 10%.

Results

Figure 8:
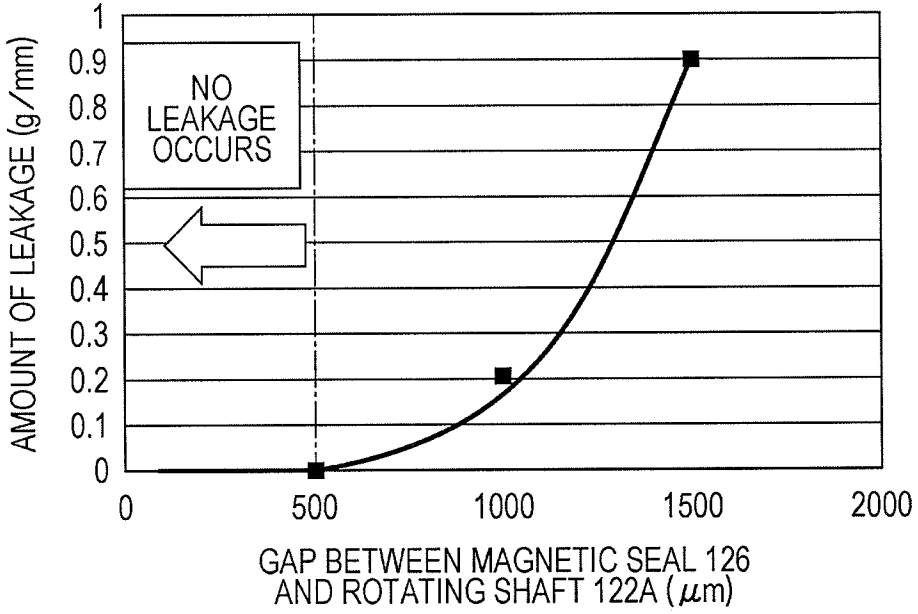
FIG. 8 is a graph illustrating the results of Evaluation 4 on the basis of the relationship between the gap between the magnetic seal and the rotating shaft of the stirring member and the width of the band of toner particles (the band width) adhered to the rotating shaft of the stirring member.
Figure 9:
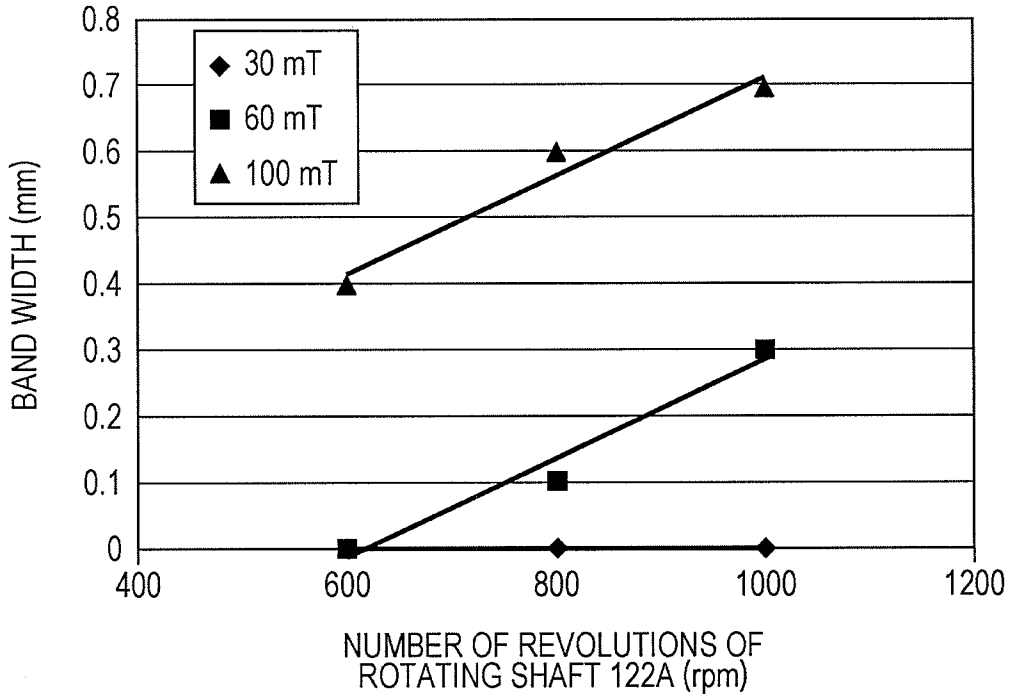
FIG. 9 is a graph illustrating the results of Evaluation 5 on the basis of the relationship between the number of revolutions (revolutions per minutes) of the rotating shaft of the stirring member and the width of the band of toner particles (the band width) adhered to the rotating shaft of the stirring member.

In each of the cases where the magnetic seal 126 is fitted in the groove 102E provided in the case 102 of the developing device 100 such that the gap L is 1000 μm and 1500 μm, respectively, the leakage of toner particles T occurs as graphed in FIG. 8. The amount of leakage increases with the increase in the gap L.

In contrast, in the case where the magnetic seal 126 is fitted in the groove 102E provided in the case 102 of the developing device 100 such that the gap L is 500 μm, the amount of leakage is zero, that is, no leakage of toner particles T occurs. Although no cases of gaps L smaller than 500 μm are tested, it is presumed that the leakage of toner particles T is not likely to occur even if the gap L is smaller than 500 μm, judging from the results of the evaluation in the case of the gap L of 500 μm.

Review of Results

In the case where the developer G according to the exemplary embodiment is transported, the toner particles T are less likely to go past the magnetic seal 126 and leak toward the side of the bearing 124 in the stirring portion 120 according to the exemplary embodiment than in a transport portion in which the gap L is 1000 μm or 1500 μm.

Evaluation 5

Outline

In Evaluation 5, the band width of toner particles T adhered to the rotating shaft 122A is measured while the number of revolutions of the rotating shaft 122A is varied among different levels. In Evaluation 5, plural magnetic seals 126 having maximum magnetic forces of 30 mT, 60 mT, and 100 mT, respectively, are prepared, and the TC is set to 10%.

Results

When the number of revolutions of the rotating shaft 122A is set to 600 rpm in the case of the magnetic seal 126 having the maximum magnetic force of 60 mT, no toner particles T adhere to the rotating shaft 122A. However, when the number of revolutions of the rotating shaft 122A is set to 800 rpm and to 1000 rpm in the case of the magnetic seal 126 having the maximum magnetic force of 60 mT, toner particles T adhere to the rotating shaft 122A. In the case of the magnetic seal 126 having the maximum magnetic force of 100 mT, toner particles T adhere to the rotating shaft 122A, regardless of the number of revolutions of the rotating shaft 122A. The band width of toner particles T on the rotating shaft 122A becomes larger as the maximum magnetic force increases and the number of revolutions increases.

In contrast, in the case of the magnetic seal 126 having the maximum magnetic force of 30 mT, no toner particles T adhere to the rotating shaft 122A, regardless of the number of revolutions of the rotating shaft 122A.

Review of Results

In the case where the developer G according to the exemplary embodiment is transported, the adhesion of toner particles T to the rotating shaft 122A is less likely to occur in the stirring portion 120 according to the exemplary embodiment than in a transport portion including a magnetic seal having a maximum magnetic force of 60 mT or 100 mT, regardless of the number of revolutions of the rotating shaft 122A.

Working Examples

Developers according to working examples (Developers 2 to 11) summarized in FIG. 10 are also subjected to Evaluations 1, 2, 4, and 5 described above. The results of Evaluations 1, 2, 4, and 5 conducted with Developers 2 to 11 are not graphed but are the same as the results obtained in the cases of the toner particles T according to the exemplary embodiment. Specifically, when the maximum magnetic force of the magnetic seal 126 is set to 20 mT or about 20 mT or greater and 50 mT or about 50 mT or smaller, none of failures such as the leakage of toner particles T and the adhesion of toner particles T to the rotating shaft 122A occurs. Developers 2 to 11 are each an exemplary developer containing toner particles having a volume mean particle size of 4.8 μm or about 4.8 μm or smaller and a storage modulus at 40° C. of $5.0\times10^6$ Pa or about $5.0\times10^6$ Pa or greater and $5.0\times10^8$ Pa or about $5.0\times10^8$ Pa or smaller, and magnetic particles having a volume mean particle size of 20 μm or about 20 μm or larger.

Comparative Examples

Developers according to comparative examples (Developers 12 to 14) summarized in FIG. 10 are also subjected to Evaluations 1, 2, 4, and 5 described above. The results of Evaluations 1, 2, 4, and 5 conducted with Developers 12 to 14 are not graphed but are different from the results obtained in the cases of the toner particles T according to the exemplary embodiment. Specifically, when the maximum magnetic force of the magnetic seal 126 is set to 20 mT or about 20 mT or greater and 50 mT or about 50 mT or smaller, failures such as the leakage of toner particles T and the adhesion of toner particles T to the rotating shaft 122A occur.

Methods of Making Developers

Methods of making the developers (Developers 1 to 9 and 11 to 13) summarized in FIG. 10 will now be described.

Making Crystalline Resin (1)

First, 100 parts by mass of dimethyl sebacate, 67.8 parts by mass of hexanediol, and 0.10 parts by mass of dibutyltin oxide are put into a three-necked flask and are made to react to one another in a nitrogen atmosphere at 180° C. for six hours while water generated during the reaction is discharged to the outside. Then, the temperature is raised to 210° C. by gradually reducing the pressure, and the reaction is continued for another six hours. Subsequently, the mixture is cooled. Thus, crystalline resin (1) having a weight-average molecular weight of 32500 is obtained.

Making Noncrystalline Resin (1)

First, 49 parts by mass of dimethyl terephthalate, 72 parts by mass of dimethyl fumarate, 55 parts by mass of dodecenylsuccinic anhydride, 157 parts by mass of bisphenol A ethylene oxide adduct, 171 parts by mass of bisphenol A propylene oxide adduct, and 0.25 parts by mass of dibutyltin oxide are put into a three-necked flask and are made to react to one another in a nitrogen atmosphere at 180° C. for three hours while water generated during the reaction is discharged to the outside. Then, the temperature is raised to 190° C. by gradually reducing the pressure, and the reaction is continued for another three hours. Subsequently, the mixture is cooled. Thus, noncrystalline resin (1) having a weight-average molecular weight of 8000 is obtained.

Making Noncrystalline Resin (2)

First, 39 parts by mass of dimethyl terephthalate, 80 parts by mass of dimethyl fumarate, 66 parts by mass of dodecenylsuccinic anhydride, 250 parts by mass of bisphenol A ethylene oxide adduct, 80 parts by mass of bisphenol A propylene oxide adduct, and 0.23 parts by mass of dibutyltin oxide are put into a three-necked flask and are made to react to one another in a nitrogen atmosphere at 180° C. for three hours while water generated during the reaction is discharged to the outside. Then, the temperature is raised to 240° C. by gradually reducing the pressure, and the reaction is continued for two more hours. Subsequently, the mixture is cooled. Thus, noncrystalline resin (2) having a weight-average molecular weight of 16500 is obtained.

Making Noncrystalline-Resin-Dispersed Liquid (1)

First, 100 parts by mass of noncrystalline resin (2) obtained as described above, 55 parts by mass of methyl ethyl ketone, and 23 parts by mass of n-propyl alcohol are put into a three-necked flask and are stirred, whereby noncrystalline resin (2) is dissolved. Subsequently, 15 parts by mass of 10% ammonia solution is added to the mixture. Furthermore, 350 parts by mass of ion exchanged water is added gradually, whereby the phase of the mixture is inverted such that the mixture is emulsified. Then, the emulsified mixture is desolvated. Thus, noncrystalline-resin-dispersed liquid (1) having a solid content concentration of 25% and in which noncrystalline resin particles having a volume mean particle size of 185 nm are dispersed is obtained.

Making Crystalline-And-Noncrystalline-Resin-Dispersed Liquid (1)

First, 10 parts by mass of crystalline resin (1), 90 parts by mass of noncrystalline resin (1), 50 parts by mass of methyl ethyl ketone, and 15 parts by mass of isopropyl alcohol are put into a three-necked flask and are heated to 60° C. while the mixture is stirred, whereby crystalline resin (1) and noncrystalline resin (1) are dissolved. Subsequently, 25 parts by mass of 10% ammonia solution is added to the mixture. Furthermore, 400 parts by mass of ion exchanged water is added gradually, whereby the phase of the mixture is inverted such that the mixture is emulsified. Then, the emulsified mixture is desolvated by pressure reduction. Thus, crystalline-and-noncrystalline-resin-dispersed liquid (1) having a solid content concentration of 25% and in which a mixture of particles of crystalline resin and noncrystalline resin that have a volume mean particle size of 158 nm are dispersed is obtained.

Making Black-Pigment-Dispersed Liquid

First, 50 parts by mass of black pigment (BLACK PEARLS (a registered trademark) L manufactured by Cabot Corporation), 5 parts by mass of nonionic surfactant (Nonipol 400 manufactured by Kao Corporation), and 200 parts by mass of ion exchanged water are mixed together, and the mixture is dispersed for about an hour by using a high-pressure-collision dispersion machine (Ultimaizer HJP30006 manufactured by SUGINO MACHINE LIMITED). Thus, a black-pigment-dispersed liquid whose water content has been adjusted such that the concentration of black pigment as the solid content in the dispersed liquid becomes 25% by mass is obtained.

Making Mold-Release-Dispersed Liquid

A solution as a mixture of 60 parts by mass of paraffin wax (HNP9 manufactured by NIPPON SEIRO CO., LTD., having a melting point of 77° C.), 4 parts by mass of anionic surfactant (Neogen RK manufactured by DAI-ICHI KOGYO SEIYAKU CO., LTD.), and 200 parts by mass of ion exchanged water is heated to 120° C., is dispersed by using a homogenizer (ULTRA-TURRAX T50 manufactured by IKA (a registered trademark) Japan K.K.), and is further dispersed at 120° C., at 350 kg/cm$^2$, and for one hour by using a Manton Gaulin high-pressure homogenizer (manufactured by Gaulin). Thus, a mold-release-dispersed liquid in which a mold releasing agent having a volume mean particle size of 250 nm is dispersed and whose water content is adjusted such that the concentration of the mold releasing agent in the dispersed liquid becomes 25% by mass is obtained.

Making Toner 1

First, 660.3 parts by mass of crystalline-and-noncrystalline-resin-dispersed liquid (1), 50 parts by mass of the black-pigment-dispersed liquid, 70 parts by mass of the mold-release-dispersed liquid, and 1.5 parts by mass of a cationic surfactant (SANISOL B-50 manufactured by Kao Corporation) are put into a round flask made of stainless steel. Furthermore, 0.1 normal of sulfuric acid is added to the mixture, whereby the mixture is adjusted to have a pH of 3.8. Subsequently, 30 parts by mass of a nitric acid solution whose concentration of poly-aluminum chloride as a flocculant is 10% by mass is added to the mixture, and the mixture is dispersed at 30° C. by using a homogenizer (ULTRA-TURRAX T50 manufactured by IKA Japan K.K.). The dispersed liquid is heated to 34° C. at a rate of 1° C./min in a heating oil bath and is then left at 34° C. for 30 minutes. Subsequently, 154.2 parts by mass of noncrystalline-resin-dispersed liquid (1) is added gradually to the dispersed liquid, and the dispersed liquid is left for one more hour. Then, 0.1 normal of sodium hydroxide is added to the dispersed liquid, whereby the dispersed liquid is adjusted to have a pH of 7.0. Subsequently, the dispersed liquid is heated to 95° C. at a rate of 1° C./min while being stirred, is then left for five hours, and is cooled to 20° C. at a rate of 20° C./min. The dispersed liquid is then filtered, is cleansed with ion exchanged water, and is dried by using a vacuum drier. Thus, Toner 1 having a storage modulus at 40° C. of $2.0\times10^8$ Pa is obtained. Toner 1 has a volume mean particle size of 3.6 μm.

Making Toner 2

Toner 2 having a storage modulus at 40° C. of $9.7\times10^7$ Pa and a volume mean particle size of 3.5 μm is made by the same method as in the case of Toner 1, except that the amount of crystalline-and-noncrystalline-resin-dispersed liquid (1) and the amount of noncrystalline-resin-dispersed liquid (1) are 666.3 parts by mass and 148.3 parts by mass, respectively.

Making Toner 3

Toner 3 having a storage modulus at 40° C. of $1.1\times10^8$ Pa and a volume mean particle size of 3.5 μm is made by the same method as in the case of Toner 1, except that the amount of crystalline-and-noncrystalline-resin-dispersed liquid (1) and the amount of noncrystalline-resin-dispersed liquid (1) are 665.9 parts by mass and 148.6 parts by mass, respectively.

Making Toner 4

Toner 4 having a storage modulus at 40° C. of $1.02\times10^7$ Pa and a volume mean particle size of 3.4 μm is made by the same method as in the case of Toner 1, except that the amount of crystalline-and-noncrystalline-resin-dispersed liquid (1) and the amount of noncrystalline-resin-dispersed liquid (1) are 667.2 parts by mass and 147.4 parts by mass, respectively.

Making Toner 5

Toner 5 having a storage modulus at 40° C. of $9.8\times10^6$ Pa and a volume mean particle size of 3.4 μm is made by the same method as in the case of Toner 1, except that the amount of crystalline-and-noncrystalline-resin-dispersed liquid (1) and the amount of noncrystalline-resin-dispersed liquid (1) are 667.4 parts by mass and 147.2 parts by mass, respectively.

Making Toner 6

Toner 6 having a storage modulus at 40° C. of $3.8\times10^8$ Pa and a volume mean particle size of 3.8 μm is made by the same method as in the case of Toner 1, except that the amount of crystalline-and-noncrystalline-resin-dispersed liquid (1) and the amount of noncrystalline-resin-dispersed liquid (1) are 646.4 parts by mass and 168.0 parts by mass, respectively.

Making Toner 7

Toner 7 having a storage modulus at 40° C. of $4.1\times10^8$ Pa and a volume mean particle size of 3.9 μm is made by the same method as in the case of Toner 1, except that the amount of crystalline-and-noncrystalline-resin-dispersed liquid (1) and the amount of noncrystalline-resin-dispersed liquid (1) are 641.4 parts by mass and 173.0 parts by mass, respectively.

Making Toner 8

Toner 8 having a storage modulus at 40° C. of $5.3\times10^6$ Pa and a volume mean particle size of 3.4 μm is made by the same method as in the case of Toner 1, except that the amount of crystalline-and-noncrystalline-resin-dispersed liquid (1) and the amount of noncrystalline-resin-dispersed liquid (1) are 667.8 parts by mass and 146.8 parts by mass, respectively, and 5 parts by mass of water glass (SNOWTEX (a registered trademark) OS manufactured by NISSAN CHEMICAL INDUSTRIES, LTD.) is added.

Making Toner 9

Toner 9 having a storage modulus at 40° C. of $4.8\times10^8$ Pa and a volume mean particle size of 3.9 μm is made by the same method as in the case of Toner 1, except that the amount of crystalline-and-noncrystalline-resin-dispersed liquid (1) and the amount of noncrystalline-resin-dispersed liquid (1) are 629.5 parts by mass and 184.7 parts by mass, respectively.

Making Toner 10

Toner 10 having a storage modulus at 40° C. of $2.0\times10^8$ Pa and a volume mean particle size of 4.8 μm is made by the same method as in the case of Toner 1, except that the amount of nitric acid solution containing 10% by mass of poly-aluminum chloride is 35 parts by mass instead of 30 parts by mass, and the dispersed liquid is heated to 38° C. at a rate of 1° C./min in a heating oil bath and is then left at 38° C. for 30 minutes instead of being heated to 34° C. at a rate of 1° C./min and then being left at 34° C. for 30 minutes.

Making Toner 11

Toner having a storage modulus at 40° C. of $4.8\times10^6$ Pa and a volume mean particle size of 3.4 μm is made by the same method as in the case of Toner 1, except that the amount of crystalline-and-noncrystalline-resin-dispersed liquid (1) and the amount of noncrystalline-resin-dispersed liquid (1) are 668.0 parts by mass and 146.6 parts by mass, respectively, and 8 parts by mass of water glass (SNOWTEX OS manufactured by NISSAN CHEMICAL INDUSTRIES, LTD.) is added.

Making Toner 12

Toner having a storage modulus at 40° C. of $5.2\times10^8$ Pa and a volume mean particle size of 4.3 μm is made by the same method as in the case of Toner 1, except that the amount of crystalline-and-noncrystalline-resin-dispersed liquid (1) and the amount of noncrystalline-resin-dispersed liquid (1) are 614.0 parts by mass and 200.1 parts by mass, respectively.

Making Toner 13

Toner 13 having a storage modulus at 40° C. of $2.0\times10^8$ Pa and a volume mean particle size of 5.0 μm is made by the same method as in the case of Toner 1, except that the amount of nitric acid solution containing 10% by mass of poly-aluminum chloride is 35 parts by mass instead of 30 parts by mass, and the dispersed liquid is heated to 40° C. at a rate of 1° C./min in a heating oil bath and is then left at 40° C. for 30 minutes instead of being heated to 34° C. at a rate of 1° C./min and then being left at 34° C. for 30 minutes.

As an additive, 1.2 parts by mass of fumed silica (RX50 manufactured by NIPPON AEROSIL CO., LTD.) is added to 100 parts by mass of each of Toners 1 to 13 by using a Henschel mixer (manufactured by MITSUI MIIKE MACHINERY Co., Ltd.). The mixing is performed at a circumferential speed of 30 m/s and for five minutes. Furthermore, 8 parts by mass of each of Toners 1 to 13 that has been mixed with the additive is mixed with 100 parts by mass of Carrier 1, whereby a two-component developer is obtained. The two-component developers containing respective Toners 1 to 13 correspond to Developers 1 to 9 and 11 to 13, respectively.

Carrier 1 mentioned above is obtained as follows. First, 14 parts by mass of toluene, 2 parts by mass of styrene-methyl methacrylate copolymer (composition ratio: styrene/methyl methacrylate=90/10; weight-average molecular weight Mw=80000), and 0.2 parts by mass of carbon black (R330 manufactured by Cabot Corporation) are stirred for ten minutes by a stirrer, whereby a coating liquid in which the foregoing materials are dispersed is obtained. Subsequently, the coating liquid and 100 parts by mass of ferrite particles (manufactured by Powdertech Co., Ltd.; Cu—Zn ferrite particles having a volume mean particle size of 23 μm) are put into a vacuum deaerating kneader (manufactured by INOUE MFG., INC.) and are stirred at 60° C. for 30 minutes. The resulting mixture is then deaerated by reducing the pressure of the mixture while being heated. The mixture is then dried and is sifted out by the size of 105 μm.

The developers (Developers 1 to 9 and 11 to 13) summarized in FIG. 10 are manufactured as described above.

While a specific exemplary embodiment of the present invention has been described in detail, the present invention is not limited thereto and may be embodied in any other way within the scope of the present invention.

For example, in the above exemplary embodiment, the magnetic seal 126 has an annular or substantially annular shape. Alternatively, the magnetic seal 126 does not necessarily have an annular or substantially annular shape as long as the magnetic seal 126 produces a magnetic field covering the entire circumference of the rotating shaft 122A. For example, plural permanent magnets may be provided around the rotating shaft 122A so as to form a magnetic seal that produces a magnetic field covering the entire circumference of the rotating shaft 122A.

The above exemplary embodiment concerns a case where the magnetic seal 126 surrounds the rotating shaft 122A at a distance from the outer circumference of the rotating shaft 122A. Alternatively, the magnetic seal 126 may be in contact with the outer circumference of the rotating shaft 122A as long as the magnetic seal 126 produces a magnetic field that covers the entire circumference of the rotating shaft 122A and is capable of restricting the transportation of the developer G. For example, the outer periphery of the magnetic seal 126 may be spaced apart from the case 102 and be fitted into the rotating shaft 122A such that the magnetic seal 126 is rotatable together with the rotating shaft 122A. In such a case, plural carrier particles CA are caught by the outer circumferential surface of the magnetic seal 126.

The above exemplary embodiment concerns a case where the supply member 112 and the stirring member 122 are each a nonmagnetic member. Alternatively, as long as the transportation of the developer G is restricted by a magnetic field produced by the magnetic seal 126, the supply member 112 and the stirring member 122 may each include a magnetic portion provided at least in the region surrounded by the magnetic seal 126 so that a magnetic field is produced by a combination of the magnetic seal 126 and the supply member 112 or the stirring member 122.

The above exemplary embodiment concerns a case where the developing portion 110 and the stirring portion 120 are provided side by side in the apparatus width direction (see FIGS. 2 and 3). Alternatively, the developing portion 110 and the stirring portion 120 are not necessarily provided side by side in the apparatus width direction as long as the developer G circulates between the developing portion 110 and the stirring portion 120. For example, the developing portion 110 and the stirring portion 120 may be provided side by side in the vertical direction.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transport mechanism comprising:

a container that stores a developer, the developer comprising toner particles having a volume mean particle size of 4.8 μm or smaller and a storage modulus at 40° C. of $5.0\times10^6$ Pa or greater and $5.0\times10^8$ Pa or smaller, and magnetic particles having a volume mean particle size of 20 μm or larger;

a transport body that transports the developer in an axial direction of a shaft about which the transport body rotates in the container while stirring the developer;

a bearing that supports the transport body such that the transport body is rotatable about the shaft;

a restricting member that has an annular shape and a maximum magnetic force of 20 mT or greater and 50 mT or smaller and restricts the transportation of the developer past the restricting portion by surrounding the shaft, the restricting member being provided nearer to a side on which the transport body transports the developer than the bearing in the axial direction of the shaft; and a fitting member having a through hole and restricting the transportation of the toner particles past the fitting member such that the fitting portion is elastically deformed while on the shaft, the fitting member being provided nearer to the side on which the transport body transports the developer than the restricting member in the axial direction of the shaft, wherein the restricting member and the fitting member are individual members and separated from each other.

2. The transport mechanism according to claim 1, wherein the toner particles contained in the developer stored in the container have a glass transition point of 50° C. or higher and 65° C. or lower.

3. A developing device comprising:

the transport mechanism according to claim 1; and a delivering member that delivers the developer transported by the transport mechanism to an image carrying body.

4. An image forming apparatus comprising:

an image carrying body that carries a latent image;

the developing device according to claim 3 that develops the latent image carried by the image carrying body into a toner image; and a transfer device that transfers the toner image developed on the image carrying body by the developing device to a medium.

5. The transport mechanism according to claim 1, wherein the restricting member and the fitting member are separated by a gap.

* * * * *